US012698622B2

(12) United States Patent
Soberano et al.

(10) Patent No.: US 12,698,622 B2
(45) Date of Patent: Aug. 4, 2026

(54) COMPOSITE FLUSH VALVE

(71) Applicant: AS America, Inc., Piscataway, NJ (US)

(72) Inventors: Eric B. Soberano, Barnegat, NJ (US); Karl Torres, Columbus, NJ (US); Walter Pitsch, Washington, NJ (US); Xiaojing Ye, Edison, NJ (US)

(73) Assignee: AS America, Inc., Piscataway, NJ (US)

( * ) Notice: Subject to any disclaimer, the term of this patent is extended or adjusted under 35 U.S.C. 154(b) by 302 days.

(21) Appl. No.: 18/569,439

(22) PCT Filed: Jun. 21, 2022

(86) PCT No.: PCT/US2022/034234
§ 371 (c)(1),
(2) Date: Dec. 13, 2023

(87) PCT Pub. No.: WO2022/271623
PCT Pub. Date: Dec. 29, 2022

(65) Prior Publication Data

US 2024/0271402 A1 Aug. 15, 2024

Related U.S. Application Data

(60) Provisional application No. 63/219,194, filed on Jul. 7, 2021, provisional application No. 63/213,552, filed on Jun. 22, 2021.

(51) Int. Cl.
*E03D 3/02* (2006.01)
*E03D 5/09* (2006.01)

(52) U.S. Cl.
CPC ..... *E03D 3/02* (2013.01); *E03D 5/09* (2013.01)

(58) Field of Classification Search
CPC .... E03D 3/02; E03D 5/09; E03D 3/00; E03D 3/04; E03D 3/06; E03D 5/105
See application file for complete search history.

(56) References Cited

U.S. PATENT DOCUMENTS

| | | | | |
|---|---|---|---|---|
| 1,297,836 | A * | 3/1919 | Gulick | F16K 21/16 251/44 |
| 2,046,004 | A | 6/1936 | Sloan | |
| 2,406,259 | A | 8/1946 | Russell et al. | |
| 3,279,742 | A | 10/1966 | Billeter | |
| 6,913,239 | B2 | 7/2005 | Nortier | |
| 7,487,950 | B2 | 2/2009 | Johnson | |

(Continued)

OTHER PUBLICATIONS

International Search Report, PCT/US2022/034234, Mail date Sep. 22, 2022, two pages.

*Primary Examiner* — Michael R Reid
(74) *Attorney, Agent, or Firm* — Tyler A. Stevenson; Anna-Lisa L. Gallo

(57) ABSTRACT

A flush valve assembly, comprising an inlet configured to receive inlet source water; an outlet configured to deliver flush water to a sanitaryware fixture; a housing; and a waterway insert configured to be positioned within the housing, wherein the housing comprises a first side opening configured to align with the flush valve assembly inlet, the housing comprises a bottom opening configured to align with the flush valve assembly outlet, the waterway insert comprises a first side opening configured to align with the housing first side opening, and the waterway insert comprises a bottom opening configured to align with the housing bottom opening.

20 Claims, 9 Drawing Sheets

(56) References Cited

U.S. PATENT DOCUMENTS

| | | | | |
|---|---|---|---|---|
| 7,934,520 | B2 | 5/2011 | Esche et al. | |
| 8,069,877 | B2 * | 12/2011 | Jacobs | F16K 31/408 137/513.5 |
| 2019/0234058 | A1 * | 8/2019 | Shakkour | E03D 5/10 |

* cited by examiner

COMPOSITE FLUSH VALVE

The disclosure relates to a flush valve for a toilet or a urinal, in particular to a composite flush valve.

BACKGROUND

Modern commercial sanitaryware often includes a flushometer flush valve apparatus. A flushometer may require a large water supply line to operate properly. A flushometer may employ water pressure from a source water supply line to provide a high-pressure flush.

Automatic flush valves may include a diaphragm or piston separating an upper chamber (or back-pressure chamber) from a lower chamber and a water supply. When a flush valve is in a steady state (not cycling through a flush), water pressure in an upper chamber is in equilibrium with water pressure in a lower chamber, and presses down on a diaphragm or piston in a closed position. To initiate a flush cycle in an automatic flush valve, a solenoid valve is opened, allowing water to be released from an upper chamber through the main flush valve. This results in a drop in water pressure in an upper chamber, causing a diaphragm or piston to lift, creating an opening to a main water supply, allowing water from a main water supply to flow through the main valve to a sanitaryware bowl to flush the bowl. To end a flush cycle, the solenoid valve is closed, an upper chamber is refilled with water through a small hole in a diaphragm or piston, and the diaphragm or piston returns to a closed rest position, shutting off the water supply to the sanitaryware.

Flush valves may typically be prepared from casted brass via a machining process. Resulting valves are heavy and costly to produce. Casted brass may also be subject to degradation if exposed to grey water. Flush valves also require high precision during manufacturing to provide required flush performance.

Desired are flush valves that are lightweight, are more easily manufactured with high tolerance, and which will not degrade when exposed to grey water.

SUMMARY

Accordingly, disclosed is a flush valve assembly, comprising an inlet configured to receive inlet source water; an outlet configured to deliver flush water to a sanitaryware fixture; a housing; and a waterway insert configured to be positioned within the housing, wherein the housing comprises a first side opening configured to align with the flush valve assembly inlet, the housing comprises a bottom opening configured to align with the flush valve assembly outlet, the waterway insert comprises a first side opening configured to align with the housing first side opening, and the waterway insert comprises a bottom opening configured to align with the housing bottom opening.

In some embodiments, a housing may comprise zinc. In some embodiments, a waterway insert may comprise a thermoplastic. In other embodiments, a waterway insert may comprise stainless steel.

BRIEF DESCRIPTION OF THE DRAWINGS

This disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
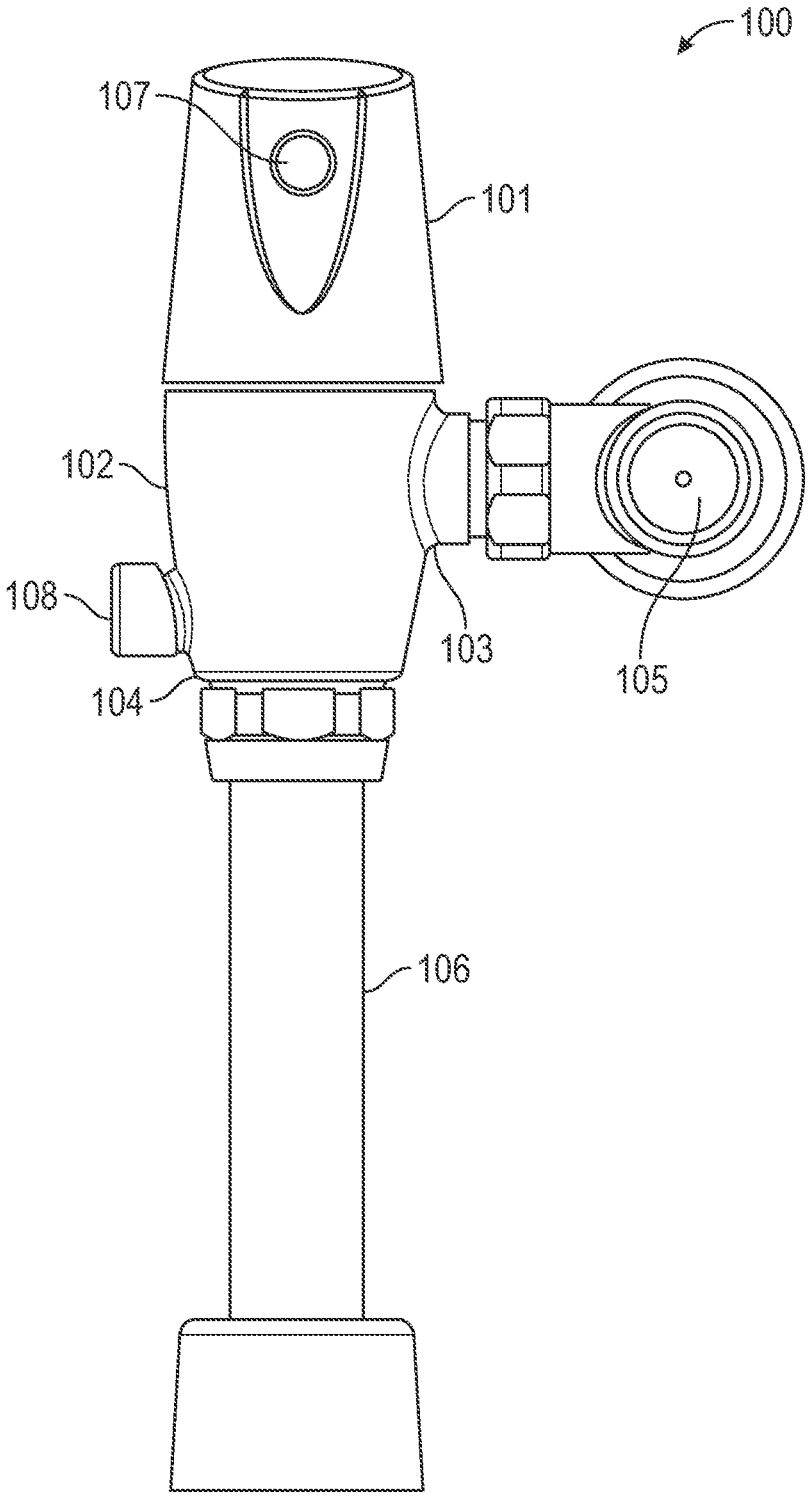
FIG. 1A shows a flush valve apparatus, according to some embodiments.

FIG. 1A shows flush valve apparatus 100, according to an embodiment. Flush valve apparatus 100 comprises upper housing 101, lower housing 102, flush valve inlet 103, flush valve outlet 104, flush water inlet pipe 105, and flush water outlet pipe 106. Inlet 103 is configured to receive inlet source water from a building water supply. Outlet 104 is configured to deliver flush water to a sanitaryware fixture to perform a flush, for example a toilet or urinal. Also shown are presence sensor 107 and manual flush button 108. Manual flush button 108 is configured to initiate a manual or "mechanical" flush. Manual flush button 108 is not electrically connected with a power source or an electrical actuator. Sensor 107 is electrically connected with a power source and an electromechanical solenoid valve. Sensor 107 may instruct a solenoid valve to initiate an automatic flush cycle upon detecting a presence and subsequent absence of a person using a toilet or a urinal.

Figure 1B:
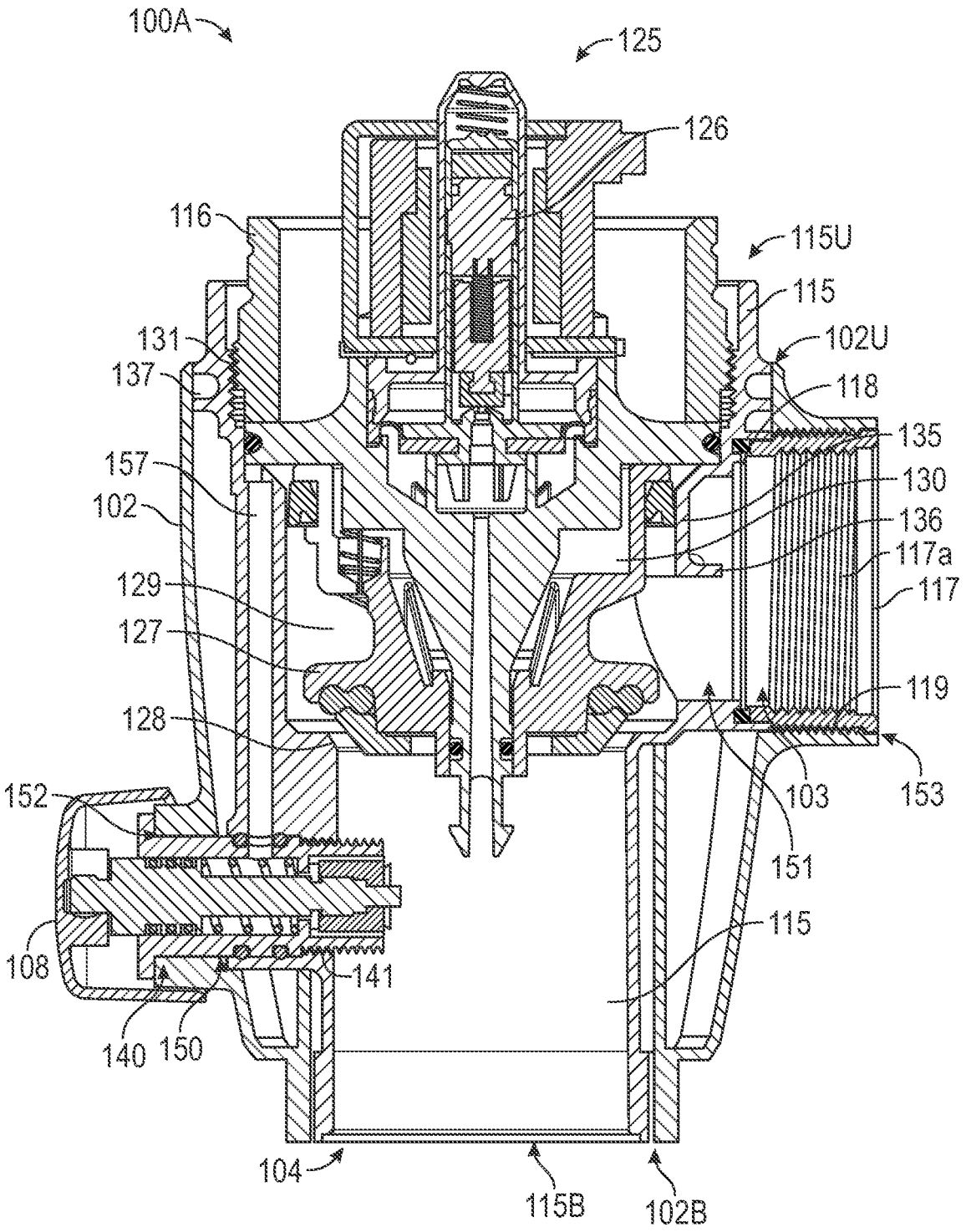
FIG. 1B provides a sectional view of a portion of a flush valve apparatus, according to an embodiment.

FIG. 1B provides a sectional view of flush valve assembly portion 100A, according to an embodiment. Piston valve assembly 125 is positioned in lower housing 102. Piston valve assembly 125 comprises solenoid valve 126, upper chamber 130, lower chamber 129, and piston 127 positioned above valve seat 128, showing valve assembly 125 in an open position. Apparatus 100 comprises waterway insert 115 coupled to bonnet nut 116 via threaded connection 131. Bonnet nut 116 may serve to maintain piston valve assembly 125 in place. Inlet adapter 117 is coupled to lower housing 102 via threaded connection 119. Waterway insert 115 and inlet adapter 117 comprise a thermoplastic. Inlet adapter 117 comprises inner threaded surface 117*a* configured to couple to a brass fitting (to couple to a source water pipe). Housing 102 comprises die-cast zinc. Compression seal 118 is positioned between inlet adapter 117 and waterway insert 115. Waterway insert 115 comprises rib 135, including horizontal rib extension 136. Rib 135 and rib horizontal extension 136 aid in directing source water from inlet 103 and protecting piston valve assembly 125 from the force of source inlet water. Waterway insert 115 is also coupled to housing 102 with seal 137. Manual flush actuator assembly 140 is coupled to waterway insert 115 via threaded connection 141. Waterway insert 115 comprises channel 157, which functions to allow water to drain from upper chamber 130 to initiate a manual flush when button 108 is actuated.

Waterway insert 115 comprises first side opening 151 which aligns with flush valve assembly inlet 103. Waterway insert 115 comprises bottom opening 115B which aligns with flush valve assembly outlet 104. Housing 102 comprises first side opening 153 which aligns with flush valve assembly inlet 103. Housing 102 comprises bottom opening 102B which aligns with flush valve assembly outlet 104. Waterway insert comprises upper opening 115U configured to receive piston valve assembly 125. Housing 102 comprises upper opening 102U aligned with upper opening 115U. Waterway insert comprises second side opening 150 configured to receive manual actuator assembly 140. Housing 102 comprises second side opening 152 aligned with second side opening 150.

Figure 1C:
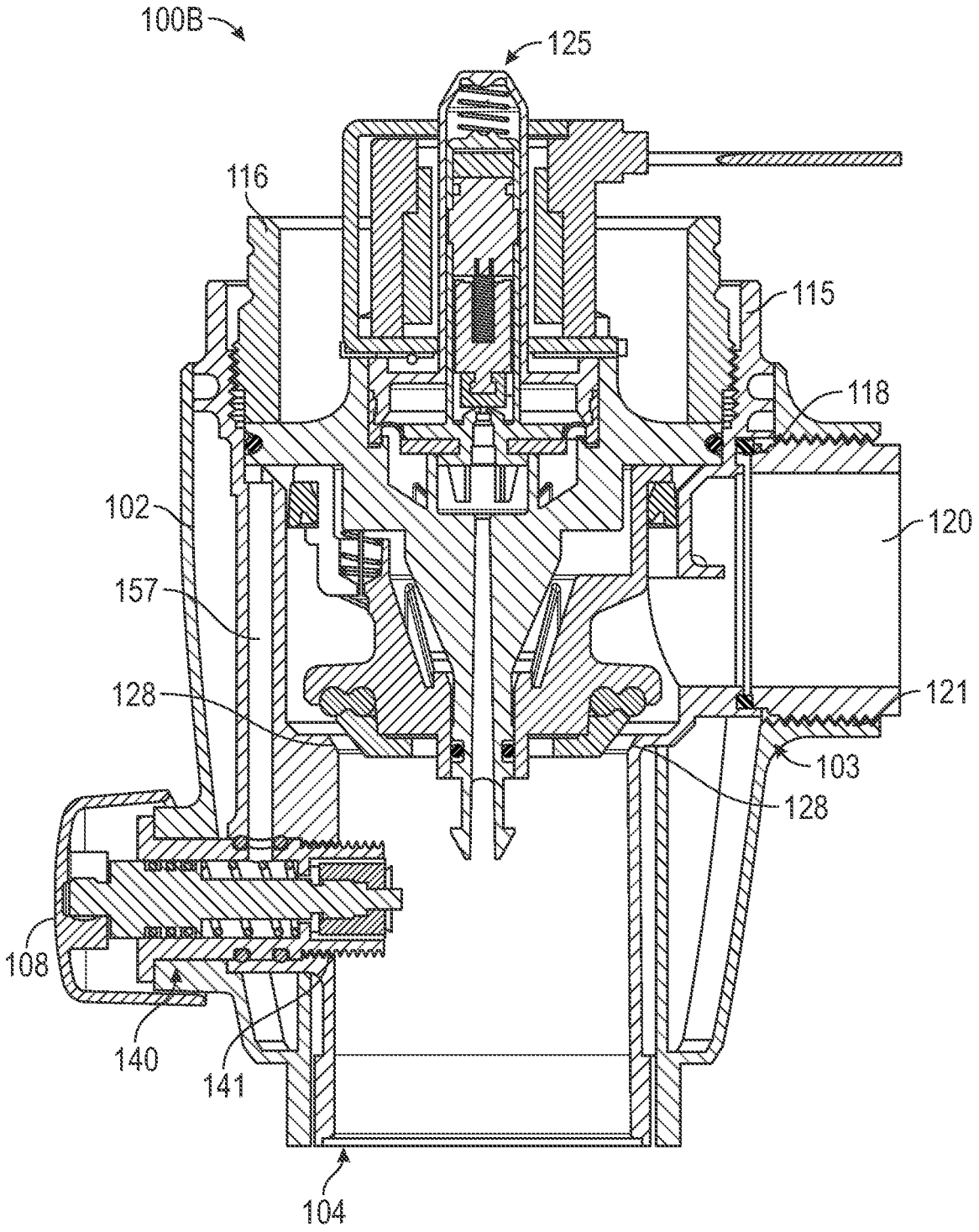
FIG. 1C provides a section view of a portion of a flush valve apparatus, according to an embodiment.

FIG. 1C provides a sectional view of flush valve assembly portion 100B, according to another embodiment. In this embodiment, apparatus 100 comprises metal inlet adapter 120. Inlet adapter 120 may comprise brass. Inlet adapter 120 is coupled to housing 102 via threaded connection 121. Inlet adapter 120 is coupled to waterway insert 115 via compression seal 118. Inlet adapter 120 is configured to be coupled directly to a source water pipe.

Figure 1D:
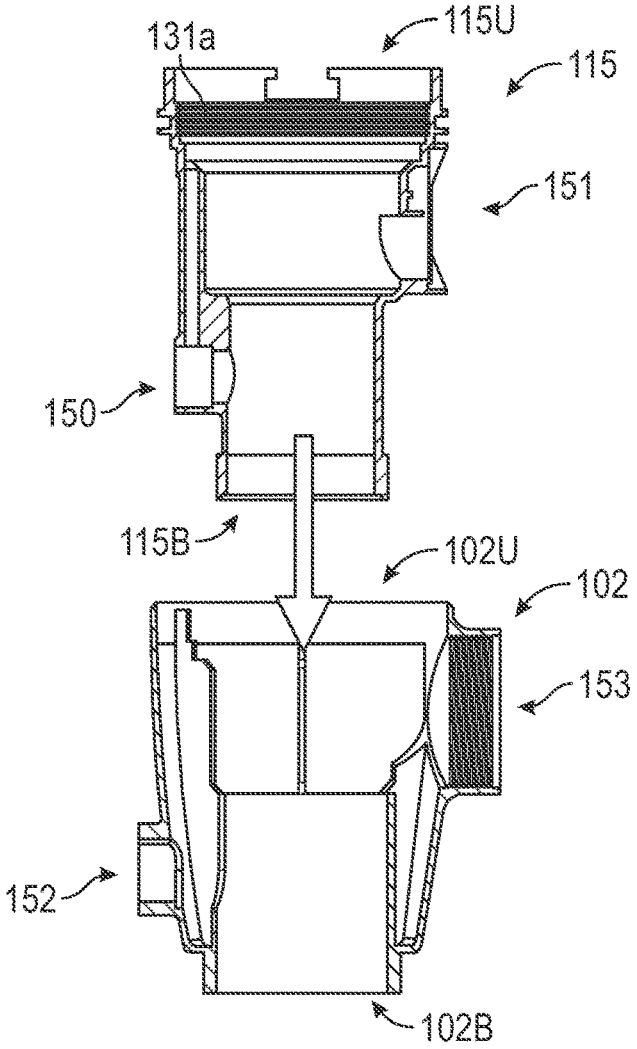
FIG. 1D, FIG. 1E, and FIG. 1F illustrate an assembly process for a flush valve apparatus, according to some embodiments.
Figure 1E:
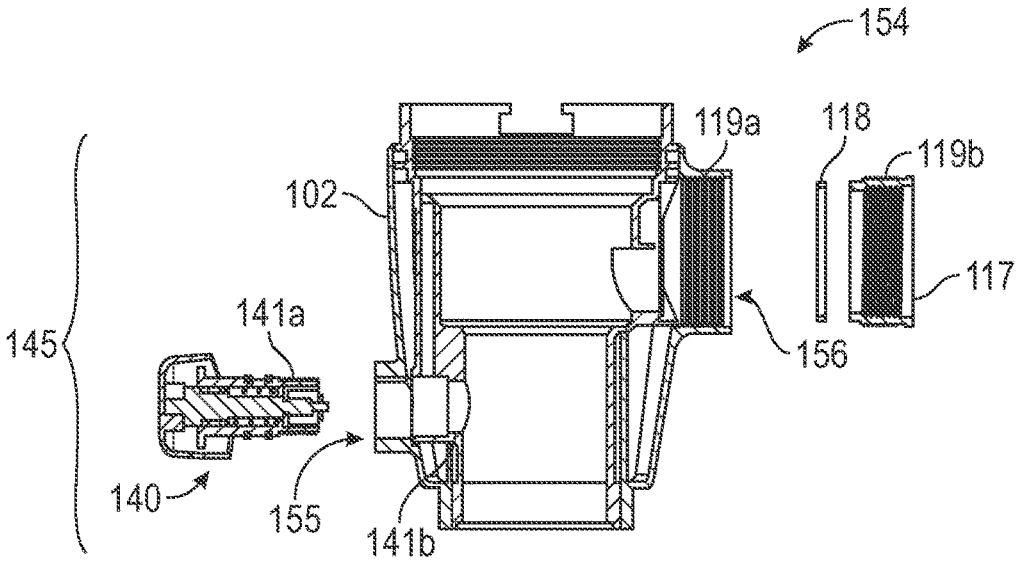
Figure 1F:
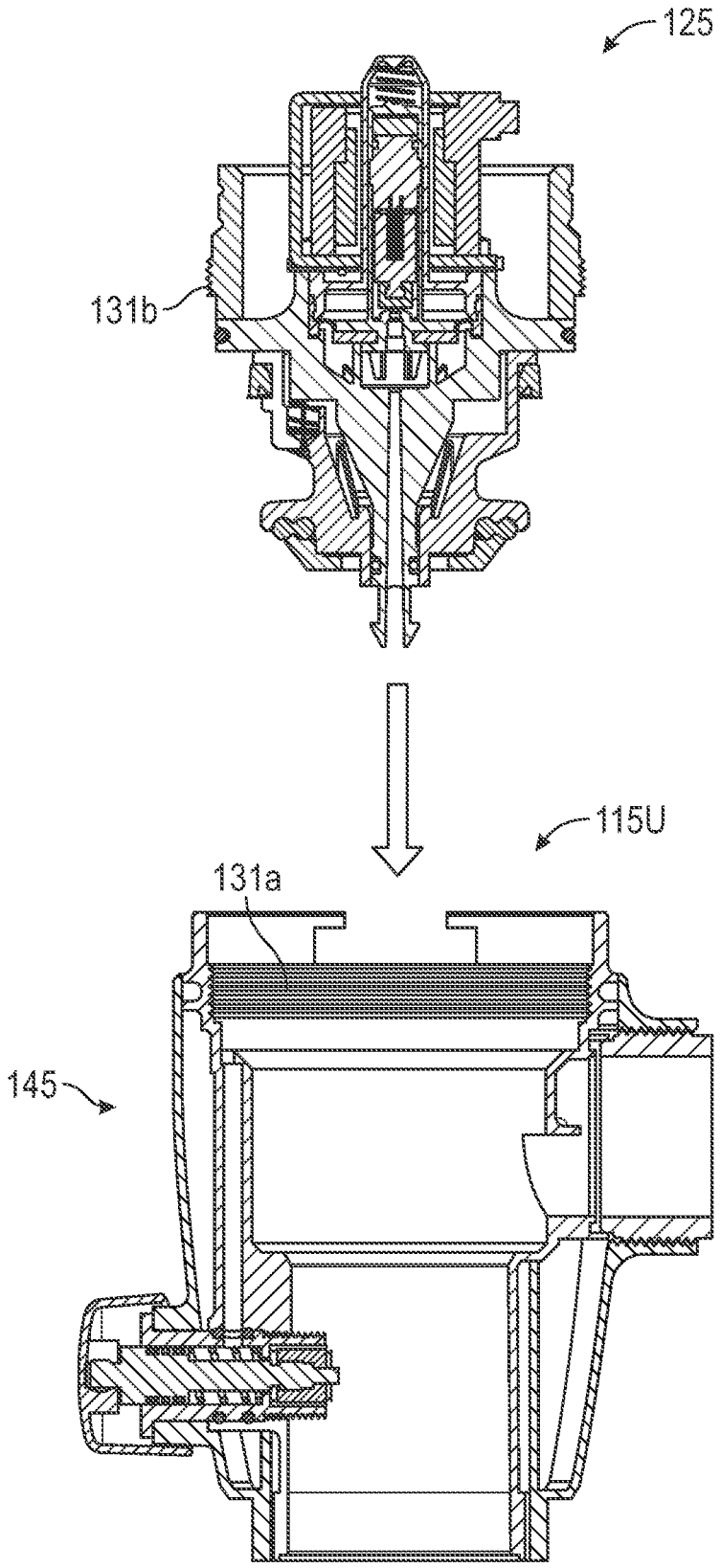

FIG. 1D, FIG. 1E, and FIG. 1F illustrate a process to assemble flush valve assembly portion 100A, according to an embodiment. In a first step, waterway insert 115 is inserted into lower housing portion 102. Waterway insert 115 comprises threaded section 131*a*, configured to mate with bonnet nut 116. Waterway insert comprises first side opening 151 configured to align with housing first side opening 153, and waterway insert comprises second side opening 150 configured to align with housing second side opening 152. Waterway insert/housing assembly 154 comprises first side opening 156 having threaded portion 119*a*, configured to mate with threaded portion 119*b* of inlet adapter 117. Compression seal 118 is configured to form a joint between inlet adapter 117 and waterway insert 115. Waterway insert/housing assembly 154 comprises second side opening 155 configured to receive manual actuator assembly 140. Threaded portion 141*a* is configured to mate with threaded portion 141*b* to form threaded connection 141. Completed assembly 145 of FIG. 1E is configured to receive piston valve assembly 125 via top opening 115U to provide assembly 100A. Threaded portions 131*a* and 131*b* are configured to join to form threaded connection 131. As shown in FIG. 1D, waterway insert 115 and housing 102 are each a unitary construct (a single part).

Figure 2A:
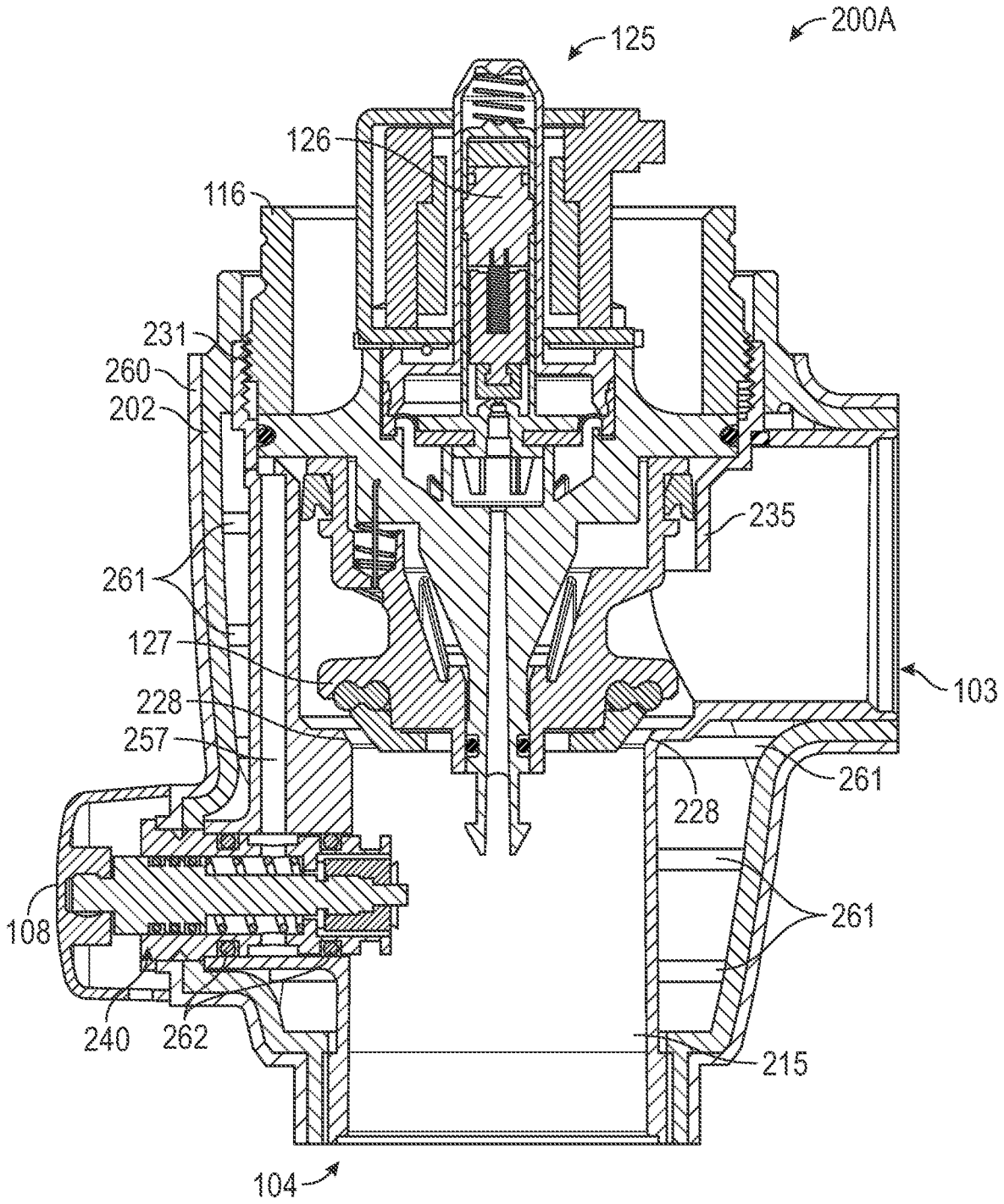
FIG. 2A shows a flush valve apparatus portion in cross-section, according to an embodiment.

FIG. 2A provides a sectional view of flush valve assembly portion 200A, according to an embodiment. Assembly portion 200A comprises piston valve assembly 125 positioned in lower housing 202. Piston 127 is in an open position positioned above valve seat 228. Waterway insert 215 is coupled to bonnet nut 116 via threaded connection 231. Manual flush activator 240 is coupled to waterway insert 215 with O-rings 262. Waterway insert 215 comprises rib 235, which serves to protect piston assembly 125 from the force of inlet source water. Housing 202 comprises a plurality of ribs 261. Portion 200A comprises overmold layer 260. Overmold layer 260 may comprise zinc. Also seen is waterway insert channel 257.

Figure 2B:
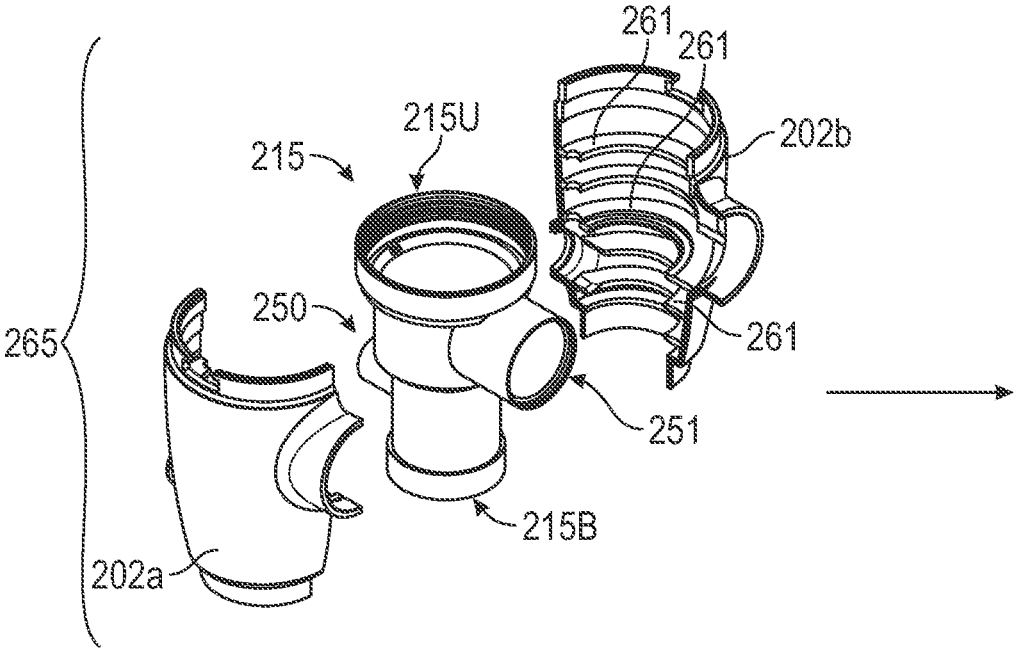
FIG. 2B, FIG. 2C, and FIG. 2D illustrate an assembly process for a flush valve apparatus, according to some embodiments.
Figure 2C:
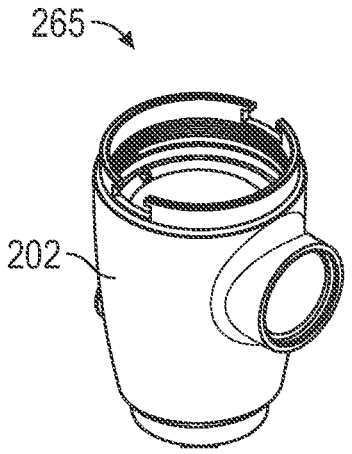
Figure 2D:
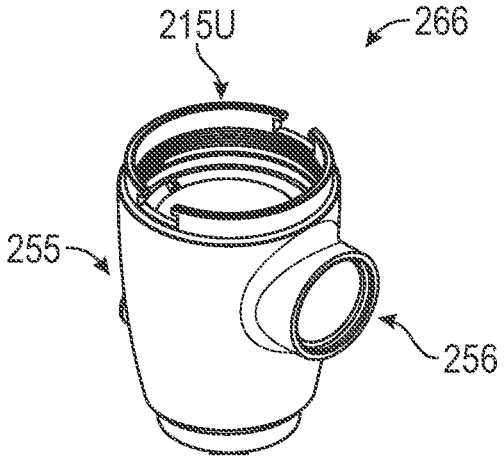

FIG. 2B, FIG. 2C, and FIG. 2D illustrate a process to assemble a flush valve assembly portion 200A, according to some embodiments. In this embodiment, lower housing sections 202*a* and 202*b* are joined together over waterway insert 215. Waterway insert 215 contains second side opening 250 and first side opening 251 configured to align with formed openings of joined sections 202*a* and 202*b*. Sections 202*a* and 202*b* comprise a plurality of ribs 261 which aid in positioning sections 202*a* and 202*b* over waterway insert 215. Assembly 265 comprises joined shell 202 which comprises zinc. Assembly 265 is overmolded to provide assembly 266 having sections 202*a* and 202*b* permanently coupled and forming a singular visible surface. Flush valve assembly 266 comprises second side opening 255 and first side opening 256, configured to receive a manual actuator assembly 240 and an inlet adapter, respectively. Top opening 215U is configured to receive piston flush valve assembly 125. As shown in FIG. 2B, waterway insert 215 is a unitary construct (a single part), while housing 202 is a sectional construct (comprises more than one part).

Figure 3A:
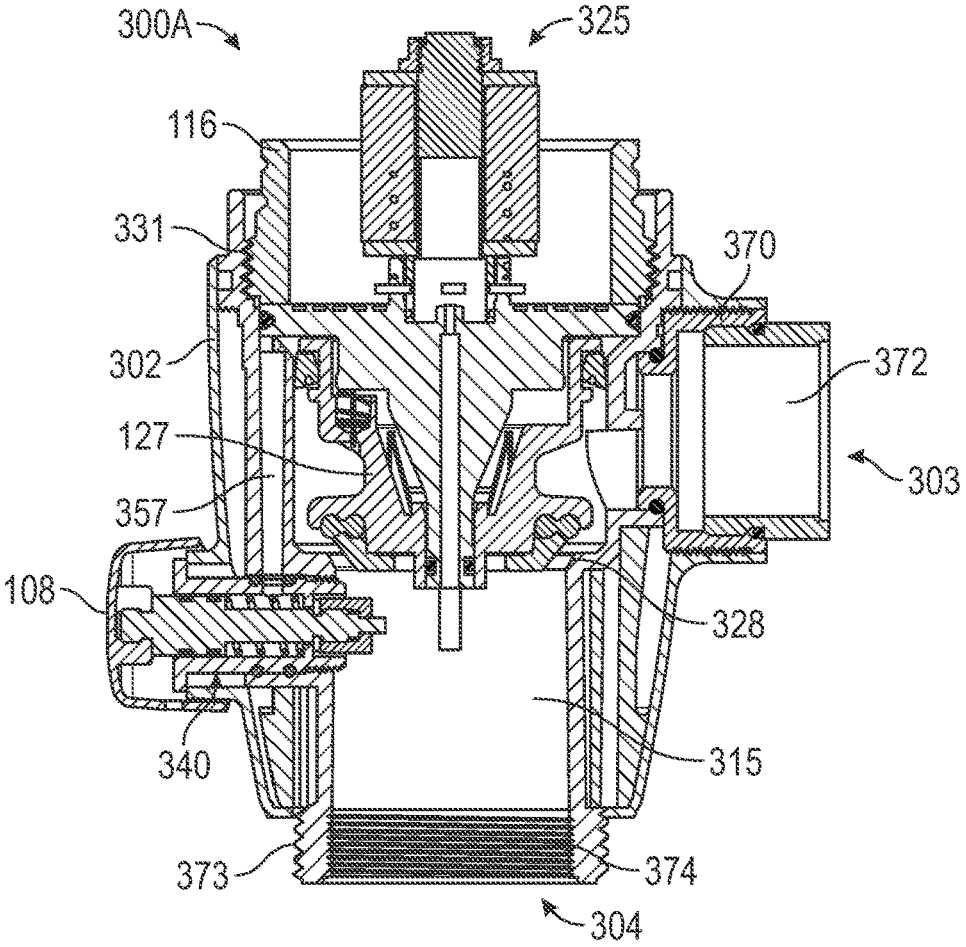
FIG. 3A and FIG. 3B provide sectional views of a flush valve apparatus portion, according to some embodiments.
Figure 3B:
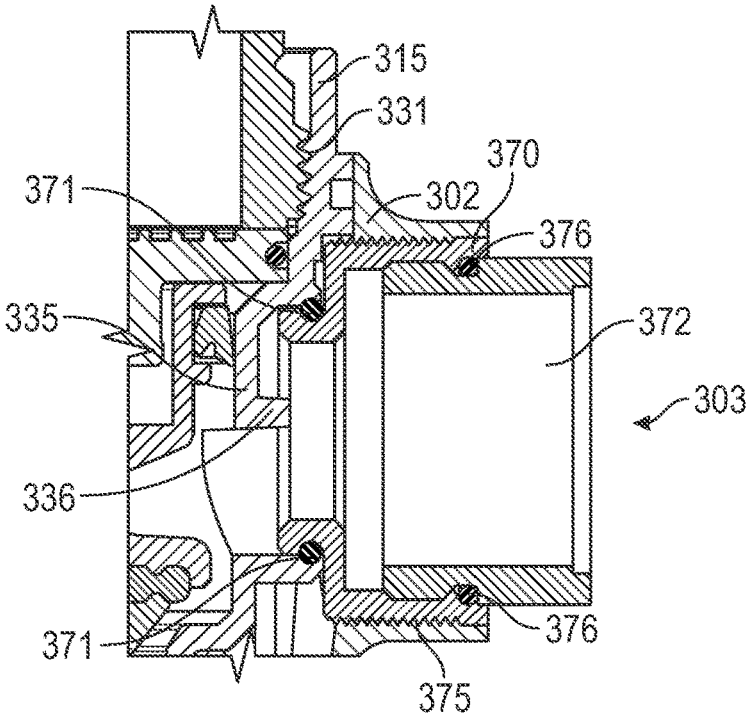

FIG. 3A provides a view of flush valve assembly portion 300A in cross-section, according to an embodiment. Visible are bonnet nut 116, housing 302, piston flush valve assembly 325, inlet 303, outlet 304, piston 127, manual activator 340, threaded connection 331, and waterway insert 315. Also shown are radial adapter 370, inlet adapter 372, waterway insert outer threaded surface 373, and waterway insert inner threaded surface 374. FIG. 3B provides a close-up view of an inlet portion of assembly portion 300A. Radial adapter 370 is threadingly coupled to zinc shell 302 via threaded connection 375. Radial adapter 370 is coupled to waterway insert 315 via radial O-ring 371. Inlet adapter 372 is coupled to radial adapter 370 via radial O-ring 376. Waterway insert 315 comprises vertical rib 335 positioned at inlet 303. Rib 335 comprises horizontal extension 336. Also shown are waterway insert channel 357 and valve seat 328.

Figure 4A:
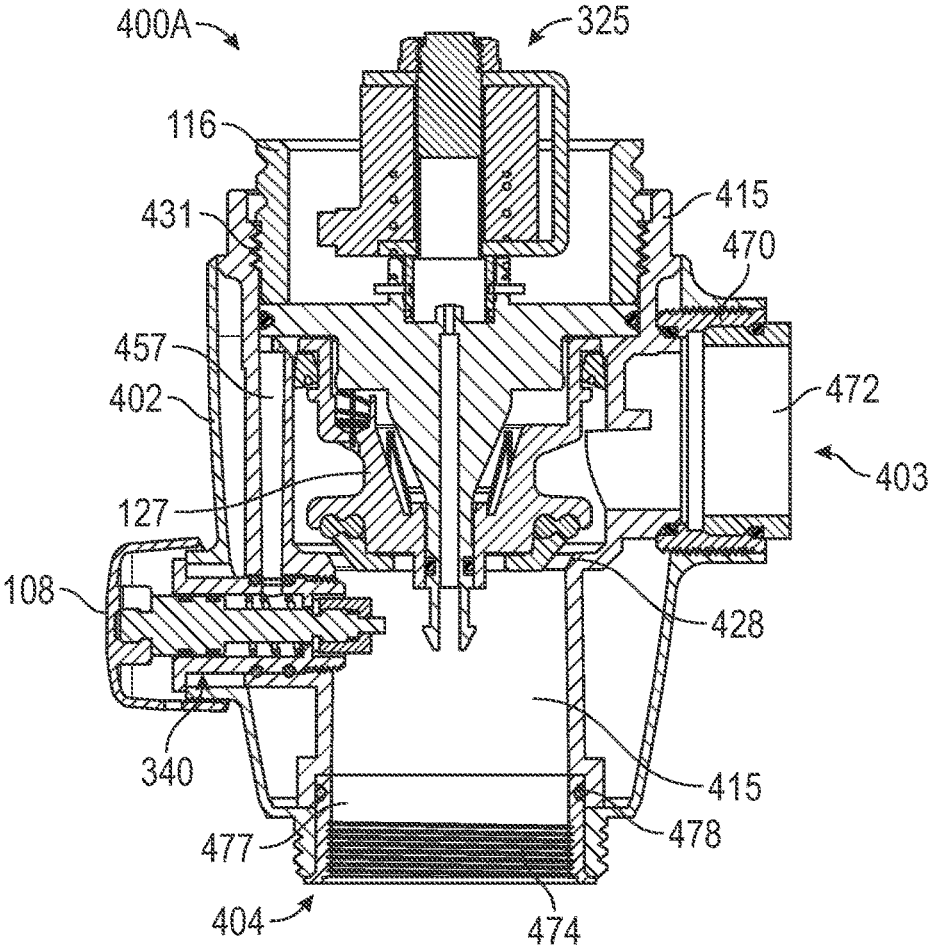
FIG. 4A and FIG. 4B provide sectional views of a flush valve apparatus portion, according to some embodiments.
Figure 4B:
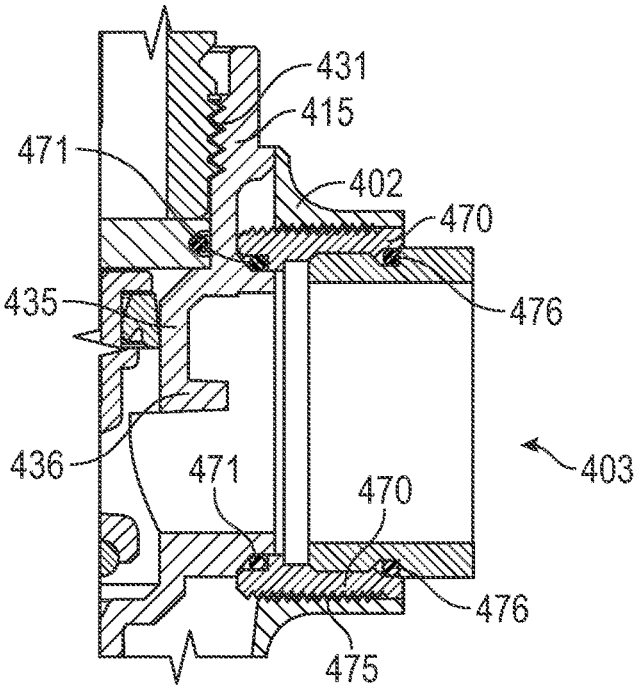

FIG. 4A provides a sectional view of flush valve assembly portion 400A, according to some embodiments. Visible are bonnet nut 116, housing 402, piston valve assembly 325, inlet 403, outlet 404, piston 127, manual activator assembly 340, threaded connection 431, and waterway insert 415. Also shown are radial adapter 470, inlet adapter 472, and outlet adapter 477. Outlet adapter 477 comprises threaded surface 474. Outlet adapter 477 is coupled to waterway insert 415 via radial O-ring 478 and is snap-fit to housing 402. FIG. 4B provides a close-up view of an inlet section of assembly portion 400A. Radial adapter 470 is threadingly coupled to zinc shell 402 via threaded connection 475. Radial adapter 470 is coupled to waterway insert 415 via radial O-ring 471. Inlet adapter 472 is coupled to radial adapter 470 via radial O-ring 476. Waterway insert 415 comprises vertical rib 435 positioned near inlet 403. Rib 435 comprises horizontal extension 436. Also shown are waterway insert channel 457 and valve seat 428.

In some embodiments, a flush valve assembly housing may comprise a metal, for example die-cast zinc, brass, or stainless steel. In some embodiments, a waterway insert may comprise a thermoplastic polymer or a metal. A waterway insert may comprise an engineering thermoplastic. A waterway insert may comprise a glass-filled thermoplastic. A waterway insert may for example comprise a polyphenylene sulfide, a polyphthalamide, a polyamide, a polyester, a polycarbonate, a polyacetal, an acrylonitrile-butadiene-styrene, copolymers thereof, or blends thereof. A waterway insert comprising a thermoplastic may be prepared via a molding process, for example injection molding. A manufacturing precision of injection molded thermoplastic may advantageously be improved over that of brass casting, a typical method to prepare a flush valve.

A waterway insert may comprise a unitary construct, that is, may comprise a single part. A flush valve assembly housing may comprise a unitary construct, or may comprise a sectional construct, that is, may comprise two or more parts. Unitary and sectional constructs are illustrated in the figures.

In other embodiments, a waterway insert may comprise stainless steel. A flush valve housing may comprise a same or a different material than a waterway insert. In some embodiments, features referred to in the figures, for example a bonnet nut, radial adapter, inlet adapter, and outlet adapter, may comprise a thermoplastic or brass. In some embodiments, an outer overmold layer, positioned adjacent an outer surface of a housing, may comprise a same or a different material than that of the housing. For example, an outer overmold layer may comprise zinc. An "overmold" layer may refer to an outer layer molded over another surface.

In some embodiments, a waterway insert may comprise most or all functional inner features of a typical flush valve housing. For example, a waterway insert may comprise an inlet to receive source water, and an outlet to deliver flush water to a sanitaryware fixture (e.g. a toilet or a urinal). In some embodiments, a waterway insert may comprise a valve seat. A piston or diaphragm valve assembly will rest on a valve seat in a closed position, and be lifted off a valve seat in an open position. In some embodiments, a waterway insert may comprise an upper opening configured to receive a piston or a diaphragm valve assembly. A waterway insert may comprise a side opening configured to receive a manual actuator assembly. In some embodiments, a waterway insert may comprise a channel (a water channel) associated with a manual actuator assembly, and configured to allow water to be delivered from an upper chamber to initiate a manual flush. In some embodiments, one or more of a waterway insert upper opening, bottom opening, first side opening to receive inlet source water, and second side opening to receive a manual flush actuator, may each be aligned with corresponding openings of a housing within which a waterway insert is positioned. In some embodiments, when openings are aligned, this may mean they share a central axis.

In some embodiments, a waterway insert may comprise a rib positioned near a source water inlet. A rib may extend in a vertical direction, perpendicular to a flow direction of inlet source water. In some embodiments, a rib may extend from an upper inlet opening downward. In some embodiments, a rib may extend about 25%, about 30%, about 35%, about 40%, about 50%, about 55%, about 60%, or more, of a diameter of an inlet opening. In some embodiments, a rib may comprise a horizontal extension. A horizontal extension may extend from the rib towards a flow direction of inlet source water. A rib or a rib having a horizontal extension may serve to protect a valve assembly from a force of flow of inlet source water during a flush cycle.

In some embodiments, a waterway insert may comprise features configured to couple to a pipe, for example an inlet or an outlet pipe. For instance, a waterway insert may comprise an outer or an inner threaded surface positioned at an inlet or outlet and configured to couple to a pipe or an adapter.

In some embodiments, a flush valve assembly comprises a presence sensor and a solenoid actuator in electrical communication, configured to facilitate an automatic flush. A presence sensor and a solenoid actuator may be in electrical communication with a battery. A flush valve assembly may comprise an upper housing and a lower housing. In some embodiments, an upper housing may comprise a presence sensor, a battery, and optionally a manual actuator assembly. In some embodiments, a lower housing may comprise an inlet, an outlet, a piston or diaphragm valve assembly, and optionally a manual actuator assembly. In the disclosure, a lower housing may simply be referred to as a "housing".

In some embodiments, an assembly may comprise a bonnet nut coupled to an upper opening of a waterway insert, which may serve to help maintain a position of a valve assembly. In some embodiments, a bonnet nut may comprise a thermoplastic, brass, zinc, or stainless steel.

Following are some non-limiting embodiments of the disclosure.

In a first embodiment, disclosed is a flush valve assembly, comprising an inlet configured to receive inlet source water; an outlet configured to deliver flush water to a sanitaryware fixture; a housing; and a waterway insert configured to be positioned within the housing, wherein the housing comprises a first side opening configured to align with the flush valve assembly inlet, the housing comprises a bottom opening configured to align with the flush valve assembly outlet, the waterway insert comprises a first side opening configured to align with the housing first side opening, and the waterway insert comprises a bottom opening configured to align with the housing bottom opening.

In a second embodiment, disclosed is a flush valve assembly according to the first embodiment, wherein the waterway insert comprises an upper opening configured to receive a piston or a diaphragm valve assembly. In a third embodiment, disclosed is a flush valve assembly according to embodiments 1 or 2, wherein the housing comprises an upper opening configured to align with the waterway insert upper opening.

In a fourth embodiment, disclosed is a flush valve assembly according to any of the preceding embodiments, wherein the waterway insert comprises a second side opening configured to receive a manual actuator assembly. In a fifth embodiment, disclosed is a flush valve assembly according to embodiment 4, wherein the housing comprises a second side opening configured to align with the waterway insert second side opening. In a sixth embodiment, disclosed is a flush valve assembly according to embodiment 5, comprising a manual actuator assembly configured to couple to the waterway insert second side opening and to the housing second side opening.

In a seventh embodiment, disclosed is a flush valve assembly according to any of the preceding embodiments, wherein the waterway insert includes a valve seat. In an eighth embodiment, disclosed is a flush valve assembly according to any of the preceding embodiments, wherein the waterway insert comprises a channel configured to be associated with a manual actuator assembly. In a ninth embodiment, disclosed is a flush valve assembly according to any of the preceding embodiments, wherein the waterway insert comprises a vertical rib configured to protect a piston or diaphragm valve assembly from a force of the inlet source water. In a tenth embodiment, disclosed is a flush valve assembly according to embodiment 9, wherein the vertical rib comprises a horizontal extension, the horizontal extension extending in the flow direction of the inlet source water.

In an eleventh embodiment, disclosed is a flush valve assembly according to any of the preceding embodiments, comprising a bonnet nut configured to couple to the waterway insert upper opening. In a twelfth embodiment, disclosed is a flush valve assembly according to any of the preceding embodiments, comprising an inlet adapter configured to couple to the housing first side opening and the waterway insert first side opening.

In a thirteenth embodiment, disclosed is a flush valve assembly according to any of the preceding embodiments, wherein the waterway insert bottom opening comprises an outer and/or inner threaded surface. In a fourteenth embodiment, disclosed is a flush valve assembly according to any of the preceding embodiments, comprising a radial adapter configured to couple to the housing first side opening, to the waterway insert first side opening, and to an inlet adapter. In a fifteenth embodiment, disclosed is a flush valve assembly according to any of the preceding embodiments, comprising an outlet adapter configured to couple to the waterway insert bottom opening and to the housing bottom opening.

In a sixteenth embodiment, disclosed is a flush valve assembly according to any of the preceding embodiments, wherein the housing comprises a first material, the waterway insert comprises a second material, and the first material is the same or different than the second material.

In a seventeenth embodiment, disclosed is a flush valve assembly according to embodiment 16, wherein the first material comprises a metal and the second material comprises a thermoplastic. In an eighteenth embodiment, disclosed is a flush valve assembly according to embodiments 16 or 17, wherein the waterway insert comprises an engineering thermoplastic. In a nineteenth embodiment, disclosed is a flush valve assembly according to any of embodiments 16 to 18, wherein the waterway insert comprises a glass-filled thermoplastic. In a twentieth embodiment, disclosed is a flush valve assembly according to any of embodiments 16 to 19, wherein the waterway insert comprises a polyphenylene sulfide, a polyphthalamide, a polyamide, a polyester, a polycarbonate, a polyacetal, an acrylonitrile-butadiene-styrene, copolymers thereof, or blends thereof.

In a twenty-first embodiment, disclosed is a flush valve assembly according to embodiment 16, wherein the waterway insert comprises stainless steel. In a twenty-second embodiment, disclosed is a flush valve assembly according to any of embodiments 16 to 21, wherein the housing comprises zinc.

In a twenty-third embodiment, disclosed is a flush valve assembly according to any of embodiments 16 to 22, wherein the housing comprises an overmold outer layer. In a twenty-fourth embodiment, disclosed is a flush valve assembly according to embodiment 23, wherein the overmold outer layer comprises a third material, and wherein the third material is the same as the first material. In a twenty-fifth embodiment, disclosed is a flush valve assembly according to embodiment 23, wherein the overmold outer layer comprises a third material, and wherein the third material is different than the first material. In a twenty-sixth embodiment, disclosed is a flush valve assembly according to any of embodiments 16 to 25, wherein the overmold outer layer comprises zinc.

In a twenty-seventh embodiment, disclosed is a flush valve assembly according to any of the preceding embodiments, wherein the housing comprises a unitary construct. In a twenty-eighth embodiment, disclosed is a flush valve assembly according to any of embodiments 1 to 26, wherein the housing comprises a sectional construct. In a twenty-ninth embodiment, disclosed is a flush valve assembly according to any of the preceding embodiments, wherein the waterway insert comprises a unitary construct.

In a thirtieth embodiment, disclosed is a flush valve assembly according to any of the preceding embodiments, wherein the housing comprises an overmold outer layer. In a thirty-first embodiment, disclosed is a flush valve assembly according to embodiment 28, wherein the housing comprises an overmold outer layer.

In a thirty-second embodiment, disclosed is a waterway insert according to any of the preceding embodiments. In a thirty-third embodiment, disclosed is a housing according to any of the preceding embodiments, and configured to receive a waterway insert at an interior space thereof.

The term "flow communication" or "fluid communication" means for example configured for liquid or gas flow therethrough and may be synonymous with "fluidly coupled". The terms "upstream" and "downstream" indicate a direction of gas or fluid flow, that is, gas or fluid will flow from upstream to downstream.

Likewise, "electrical communication" may mean "electrically coupled". Electrical communication may be via wired connection or may be wireless.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A flush valve assembly, comprising an inlet configured to receive inlet source water;

an outlet configured to deliver flush water to a sanitary-ware fixture;

a housing; and a waterway insert configured to be positioned within the housing, wherein the housing comprises a first side opening configured to align with the flush valve assembly inlet, the housing comprises a bottom opening configured to align with the flush valve assembly outlet, the waterway insert comprises a first side opening configured to align with the housing first side opening, the waterway insert comprises a bottom opening configured to align with the housing bottom opening, and the waterway insert comprises a vertical rib configured to protect a piston or diaphragm valve assembly from a force of the inlet source water.

2. The flush valve assembly according to claim 1, wherein the waterway insert comprises an upper opening configured to receive the piston or the diaphragm valve assembly, and wherein the housing comprises an upper opening configured to align with the waterway insert upper opening.

3. The flush valve assembly according to claim 1, wherein the waterway insert comprises a second side opening configured to receive a manual actuator assembly, and wherein the housing comprises a second side opening configured to align with the waterway insert second side opening.

4. The flush valve assembly according to claim 1, wherein the waterway insert includes a valve seat.

5. The flush valve assembly according to claim 1, wherein the waterway insert comprises a water channel configured to be associated with a manual actuator assembly.

6. The flush valve assembly according to claim 1, comprising a piston valve assembly.

7. The flush valve assembly according to claim 1, wherein the vertical rib comprises a horizontal extension, the horizontal extension extending in the flow direction of the inlet source water.

8. The flush valve assembly according to claim 2, comprising a bonnet nut configured to couple to the waterway insert upper opening.

9. The flush valve assembly according to claim 1, wherein the housing comprises a first material, the waterway insert comprises a second material, and the first material is different than the second material.

10. The flush valve assembly according to claim 9, wherein the first material comprises a metal and the second material comprises a thermoplastic.

11. The flush valve assembly according to claim 9, wherein the waterway insert comprises an engineering thermoplastic.

12. The flush valve assembly according to claim 9, wherein the waterway insert comprises a glass-filled thermoplastic.

13. The flush valve assembly according to claim 9, wherein the waterway insert comprises stainless steel.

14. The flush valve assembly according to claim 9, wherein the housing comprises zinc.

15. The flush valve assembly according to claim 1, wherein the housing comprises an overmold outer layer.

16. The flush valve assembly according to claim 15, wherein the overmold outer layer comprises zinc.

17. The flush valve assembly according to claim 1, wherein the housing comprises a unitary construct.

18. The flush valve assembly according to claim 1, wherein the housing comprises a sectional construct.

19. The flush valve assembly according to claim 1, wherein the waterway insert comprises a unitary construct.

20. The flush valve assembly according to claim 1, wherein the waterway insert comprises a unitary injection molded part.

* * * * *